US009156065B2

(12) United States Patent
Hug

(10) Patent No.: US 9,156,065 B2
(45) Date of Patent: Oct. 13, 2015

(54) SORTING AND INSPECTION APPARATUS AND METHOD WITH DETERMINATION OF PRODUCT VELOCITY

(75) Inventor: Anthony Hug, London (GB)

(73) Assignee: Buhler Sortex Ltd., London (GB)

( * ) Notice: Subject to any disclaimer, the term of this patent is extended or adjusted under 35 U.S.C. 154(b) by 0 days.

(21) Appl. No.: 14/129,333

(22) PCT Filed: Jun. 28, 2012

(86) PCT No.: PCT/GB2012/051513
§ 371 (c)(1),
(2), (4) Date: Mar. 21, 2014

(87) PCT Pub. No.: WO2013/001303
PCT Pub. Date: Jan. 3, 2013

(65) Prior Publication Data

US 2014/0284255 A1 Sep. 25, 2014

(30) Foreign Application Priority Data

Jun. 28, 2011 (GB) ..... 1111022.8

(51) Int. Cl.
*B07C 5/342* (2006.01)

(52) U.S. Cl.
CPC ..... *B07C 5/342* (2013.01); *B07C 5/3425* (2013.01); *B07C 5/3427* (2013.01)

(58) Field of Classification Search
CPC ..... B07C 5/365; B07C 3/082; B07C 5/02; B07C 5/3425; B07C 5/366; B07C 5/342; B07C 5/3416; B07C 5/36; B07C 5/3422; B07C 5/3427; B07B 4/02; B07B 4/08; B07B 13/08; B07B 11/06; B07B 4/075; B07B 13/10; B07B 7/04; B07B 13/003; A24B 1/04; G01N 21/88; B01D 21/283
USPC ..... 209/577, 580, 587, 638, 639, 644
See application file for complete search history.

(56) References Cited

U.S. PATENT DOCUMENTS 4,848,590 A 7/1989 Kelly
5,158,181 A 10/1992 Bailey (Continued)

FOREIGN PATENT DOCUMENTS

DE 34 43 476 5/1986
GB 2452164 2/2009

(Continued)

OTHER PUBLICATIONS

PCT, Notification Concerning Transmittal of Copy of International Preliminary Report on Patentability, in Application No. PCT/GB2012/051513, dated Jan. 16, 2014. (8 pages).
GB Search Report corresponding to GB Patent Application No. 1111022.8, Oct. 21, 2011.

(Continued)

*Primary Examiner* — David H Bollinger
(74) *Attorney, Agent, or Firm* — McAndrews, Held & Malloy, Ltd.

(57) ABSTRACT

A sorting and inspection apparatus comprising a feed system for delivering a product stream sequentially through an imaging zone and a sorting zone, at least one tight source for illuminating a product at the imaging zone, at least one optical sensor and detector circuit for viewing at least a portion of the illuminated product at the imaging zone, for collecting viewed data, for determining a condition of that at least portion of the illuminated product from the viewed data and then for outputting a signal dependent upon the determined condition of that at least portion of the illuminated product, and at least one ejector for ejecting product at the sorting zone dependent upon the output signal. The imaging zone comprises at least two sensor zones, sequentially arranged one after another in a direction of the product stream. The data collected from the at least two sensor zones is temporally delayed between an earlier one of the sensor zones and a subsequent sensor zone, with the temporal delay being set at a time that would match a sensor output for the said earlier one of the sensor zones with a sensor output for the said subsequent sensor zone for a hypothetical product travelling through the viewing zone at a fixed, predetermined velocity. The apparatus additionally determines the velocity of each product that passes through the sensor zones. The determined velocity, or its difference from the predetermined velocity, used in a determination of a shortened but non-clipped sector of each sensor zone from which to use collected data for basing its defect determination.

11 Claims, 6 Drawing Sheets

(56) References Cited

U.S. PATENT DOCUMENTS

| | | | | |
|---|---|---|---|---|
| 5,538,142 | A * | 7/1996 | Davis et al. | 209/580 |
| 5,873,470 | A * | 2/1999 | Davis et al. | 209/555 |
| 8,809,718 | B1 * | 8/2014 | Doak et al. | 209/576 |
| 2006/0016735 | A1 | 1/2006 | Ito et al. | |
| 2012/0074047 | A1 * | 3/2012 | Deefholts | 209/587 |
| 2014/0054204 | A1 * | 2/2014 | Christel | 209/587 |

FOREIGN PATENT DOCUMENTS

| | | |
|---|---|---|
| GB | 2475344 | 5/2011 |
| WO | WO98/18574 A1 | 5/1998 |

OTHER PUBLICATIONS

International Search Report for International Patent Application No. PCT/GB2012/051513, mailed Nov. 27, 2012.

* cited by examiner

SORTING AND INSPECTION APPARATUS AND METHOD WITH DETERMINATION OF PRODUCT VELOCITY

CROSS-REFERENCE TO RELATED APPLICATIONS

None

STATEMENT REGARDING FEDERALLY SPONSORED RESEARCH OR

None

THE NAMES OF THE PARTIES TO A JOINT RESEARCH AGREEMENT

None

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

None

STATEMENT REGARDING PRIOR DISCLOSURES BY THE INVENTOR OR A JOINT INVENTOR

None

BACKGROUND OF THE INVENTION (1) Field of the Invention

The present invention relates to a sorting and inspection apparatus, and particularly an optical sorting and inspection apparatus, for example for inspecting and then sorting bulk food stuffs such as grain, rice, nuts, pulses, fruit and vegetables. Examples of such apparatus are described in International Patent Publication No: WO98/018574, European Patent Publication No: EP0838274, US patent Specification No: U.S. Pat. No. 4,630,736 and GB Patent Publication No. GB2471885, the entire disclosures of which are hereby incorporated by reference.

(2) Description of Related Art

In machines of these types, a stream of products to be sorted is delivered, usually in free flight, through an imaging zone and a sorting zone. In the imaging zone, designated defects are looked for, and in the sorting zone, any products on which defects have been identified, and which products are thus to be rejected, are removed or separated from the stream of products. The removal is usually by way of one or more blasts of gas, such as air, from one or more ejectors disposed adjacent the stream of products.

In such machines, the required throughput is normally determined by the production rates elsewhere in the processing plant. Normally though, the required throughput is high and is typically measured in tonnes per hour, whereby for small products, the throughput is very rapid, with large numbers being sorted every second.

Food producers often use sorting and inspection apparatus, such as optical sorting machines, to sense defects in their foodstuffs, and thus to allow the removal of any defective, i.e. non-standard, products from the product stream. This in turn allows the sorted product to meet a client's agreed grade or quality standard, but yet while still maximising the total production yield from the unsorted product stream to the best extent possible, in a given timeframe. The quality standard usually specifies individual maximum levels of contamination for different types of defect. For example, when sorting rice, the defects might be insect-damaged "peck-grains", or chalky grains or yellow grains, with maximum levels for these contaminants being say less than 0.1% peck, less than 1% chalky and less than 0.2% yellow. Some customers also specify restrictions on the numbers of grey grains.

As used herein, the term "defect" or "defective" should be understood to include both blemishes on articles being sorted and whole articles/products which are unsatisfactory for that reason, or for another reason. It can also include foreign material or extraneous product.

Optical sorting machines identify defects in the product being sorted by using known techniques, such as by continuously analysing images of product (or parts of products) in the stream, taken at the imaging zone using sensors. Output signals from an image analyser can then be used to allow a control system to instruct the ejectors as appropriate, so as to eject the defects identified in the images, and thus also the products featuring those defects.

Usually the sensors are optimised to detect a particular type of defect. However, a sensor, or a line on a sensor, can be optimised for a specific sorting criteria, which sensor or line on a sensor may then also happen to usefully detect another type of defect, either because a product has more than one type of defect or because the sorting criteria are not wholly independent of each other. Optimisation may be by having each sensor or line of sensor look at a particular wavelength of light, or set of wavelengths of light, such as by providing the sensor or the line of pixels of the sensor with a specific filter. Alternatively or additionally, the light source may be tuned to provide at the viewing window of the sensor, or for a line thereof, an illumination of the product steam characterised by a desired wavelength or set of wavelengths of light, or with an illumination that omits certain undesired wavelengths, so as to suit the defect detection optimisation. This also can be achieved with filters, for filtering the emitted light prior to illuminating the product stream. Flashing lights can also allow alternating light colours.

With regard to that optimisation, there is no certainty that a given optimisation will offer exclusive detection for a specific form of defect. For example, an optimised detection criteria for rice, designed to detect peck-grains, may also identify some chalky and some yellow grains for removal. Furthermore, even though a particularly optimised detection criteria will typically identify the majority of one type of defect, it can also incorrectly classify some good products as being defective, since the optimisation is not necessarily optimised or appropriate as a means of detection for other forms of defect. For this reason, different criteria detections, using more than one optimisation, can be carried out either simultaneously using prisms, or in series as the product passes down or across through the imaging zone, again potentially using a flashing light source with sequential variable colours, or using different filters on two or more sensors or two or more lines of a sensor). For example, a first defect criteria detection may be carried out in a first part or line of the imaging zone, potentially using a first flash of illumination, perhaps of a first colour, e.g. blue, and a second defect criteria detection may be carried out in a fractionally spaced, usually lower, second part or line of the imaging zone, potentially using a second flash of illumination, perhaps of a different colour, e.g. red. These serial detections then allow both for two optimised detections to be carried out so as to allow the sensor(s) to optimally check for two or more different defects, and thus offer detection by means of individual optimisations. Where appropriate or possible given the optimisations used and the given characteristics of the detected product, it could also allow for cross-checking or correlation between the sequential or separate detections made by the detection circuit.

A problem occurs, however, with sequential detections, whether using flashing illuminations or frame by frame detections, in terms of matching up one detection with the next, so as to allow a cross-check or correlation to be performed, and that is related to the fact that whereas the frequency of the flashing, or the frequency of the image frame rate, or both, is typically fixed for a given viewing zone of a sorting apparatus, the speed of passage (velocity) of the individual, sequential, products in the product stream passing through that viewing zone is not fixed at the imaging zone—some products are travelling faster than others. After all, a product's velocity can depend on a number of situational characteristics, such as the design/features of the apparatus, the characteristics of the products themselves, the ambient environmental conditions, and the individual interactions between the various elements and products involved. For example, in rice sorting equipment, where the rice grain is passing through the viewing zone effectively in free fall, the velocities in the feed plane, i.e. through the imaging zone, are typically going to be anywhere between 3.5 m/s and 4.3 m/s. As a result, the specific timing of the commencement of the passage of a particular product into each part of the viewing zone is somewhat random. As such, there can be variations in the detection images used for the two or more sequential steps in the detection process, from one line or one sensor to the next, thereby making it hard to cross-check the separate detections, and this can lead to variable detection accuracy. Attempts in the past to compensate for this have included trying to synchronise timing of flashed illumination to the products in the product stream, but that is too complicated, especially since a sorting apparatus may feature many separate product streams, each steam potentially being perhaps no more than a meter wide with a product flow in the order of more than one tonne per hour, and thus very densely populated with grains, and it is possible that the average speeds of those separate product streams will themselves be different or non-constant over time, since ambient condition can change or since different streams on a machine may have different functions, i.e. a flat or primary stream may have an average speed of 3.9 m/s and a re-sort or channelled stream may have an average speed of perhaps 3.5 m/s, and yet both may be on the same machine. Further, the multiple product streams are likely each to have their own viewing zone, and thus may have their own sensor(s) and light source(s). Therefore the product streams may be desired to be configured/synchronised separately for optimising detection performance.

As such, optimally setting up the system so as to allow a correlation of detections from one sensor or line to the next, i.e. for comparing detections on supposedly the same portion of a product in a given product stream, and doing the same for every product in every product stream, is less than straightforward.

BRIEF SUMMARY OF THE INVENTION

The present invention, therefore, seeks to provide a mechanism by which variations in product flow velocity through the imaging zone can be accommodated.

According to the present invention there is provided a sorting and inspection apparatus comprising:

a feed system for delivering a product stream sequentially through an imaging zone and a sorting zone, at least one light source for illuminating a product at the imaging zone, at least one optical sensor and detector circuit for viewing at least a portion of the illuminated product at the imaging zone, for collecting viewed data, for determining a condition of that at least portion of the illuminated product from the viewed data and then for outputting a signal dependent upon the determined condition of that at least portion of the illuminated product, and at least one ejector for ejecting product at the sorting zone dependent upon the output signal, wherein the imaging zone comprises at least two sensor zones, sequentially arranged one after another in a direction of the product stream, with the at least one light source being arranged to illuminate at least a portion of a product as it passes through the at least two sensing zones, and with the at least one optical sensor being arranged to receive either or both reflected and transmitted light from the illuminated product as it passes through the at least two respective sensing zones so as to allow a collection of viewed data of at least the illuminated portion of the product as the product passes through the at least two sensor zones, the data collected from the at least two sensor zones being temporally delayed between an earlier one of the sensor zones and a subsequent sensor zone, with the temporal delay being set at a time that would match a sensor output for the said earlier one of the sensor zones with a sensor output for the said subsequent sensor zone for a hypothetical product travelling through the viewing zone at a fixed, predetermined velocity;

characterised in that the apparatus additionally determines the velocity of each product that passes through the sensor zones and, for each such product, the respective determined velocity, or its difference from the predetermined velocity, is arranged to be used in a determination of a shortened but non-clipped sector of each sensor zone from which to use collected data for basing its defect determination, that determination being such that the shortened but non-clipped sectors of collected data for both the said one of the sensor zones and the said subsequent sensor zone will match substantially correctly onto each other.

The sectors, by being shortened, will be smaller than the full length of the sensor zones themselves. Further, being non-clipped means that they fall fully within the extent of their respective sensor zone, rather than having ends clipped off, i.e. falling outside of their respective sensor zone. By choosing the appropriate shortened but non-clipped sectors, faster and slower products can still be properly inspected in both zones, whilst also permitting a correct matching of the two detections for allowing accurate cross-checking between the two defect determinations. However, if instead the full height of the sensor zones are considered, then faster and slower products would be located differently on the two or more comparative sets of collected data, i.e. in different positions thereon, whereby they would not correctly match, and cross-checking or correlation between the defect determinations would not be so readily achievable.

The at least one sensor may be a separate sensor for each sensor zone, or potentially a single sensor, with one or more lines of that single sensor being arranged for collecting data from the respective sensor zones, i.e. one or more line per sensor zone.

The product stream may pass along a product chute in its passage towards the viewing zone. The product chute may divide an initial feed from a hopper into a plurality of product streams. The separation may be via a comb-like arrangement.

In an apparatus with multiple product streams, each product stream may comprise a sequence of individual products, with the products typically being spaced apart along the longitudinal direction of the stream, albeit usually not with a consistent product spacing. A less ordered product stream, however, may also be processed using the present invention, although the products typically might be arranged to pass through the viewing and sorting zones in a single layer, whereby products cannot be masked from the sensors, or lines of the sensors, by other products.

The product stream through the viewing zone and the sorting zone might be driven purely by gravity. This allows the speed of the product to be known once the entry speed into the viewing zone is known—preferably products in the product stream exit the product chute for free flight through both the viewing zone and the sorting zone.

Preferably the predetermined velocity is approximately the median velocity for the product stream through the viewing zone of the sorting apparatus.

The predetermined velocity may be between 2 and 5 m/s, and more preferably between 3.5 m/s and 4.3 m/s.

The predetermined velocity may be about 3.8 m/s The temporal delay may be between 60 .mu.s and 90 .mu.s and more preferably between 69 .mu.s and 83 .mu.s.

The temporal delay may be about 76.4 .mu.s.

The lines of the sensor might be displaced at least 0.29 mm relative to one another, or a distance corresponding to the distance travelled by the hypothetical product per scan period.

The at least one light source typically will flash its illumination, usually at a fixed flash-frequency. Preferably that frequency synchronises with the scan period of the sensors, i.e. the flash frequency synchronises with the temporal delay between the sensor zones. In a preferred arrangement the scan period is equal to the temporal delay. This may be, for example, 76.4 .mu.s, whereupon the frequency may be about 6.5 kHz (1/(2.times.0.0000764) if there are two flashes per illumination cycle—one of each colour) or 13 kHz where there is a single flash per illumination cycle.

The at least one light source may use either a different wavelength of light or a different set of wavelengths of light for each sensing zone. The change of colour arising therefrom might oscillate at a frequency to synchronise with the scan period of the sensors, i.e. the flash frequency synchronises with the temporal delay between the sensor zones. In this manner, data captured for a product and data captured for that same product falling through the subsequent sensor zone will represent the data using the second wavelength or set of wavelengths. The two sensors thus can be optimised for different defect detection criteria.

In place of, or in addition to, the flashing illumination, different filters may be provided for the sensors, or the lines of the sensor, for each sensor zone, whereby again the data captured for a product falling through one of the sensor zones will be useable for a first defect detection criteria, whereas the data collected for the same product falling through the subsequent sensor zone will be useable for a different defect detection criteria.

Instead of, or in addition to, the changes in wavelength (i.e. colour), or the use of filters, it is possible for the changes or alternations to be in terms of the light's wave amplitude, i.e. its brightness or intensity. As such, the intensity of the illumination may be alternated or adjusted or changed to suit or optimise for the type of products being inspected, or to meet client requirements for product quality control, e.g. whiteness requirements for rice grains, or to correct for manufacturing tolerances in the light-source—e.g. the light output of the lamps or LEDs, which are not necessarily perfectly consistent from one light source to the next. Therefore, the first and second light means may emit light in different amplitude ranges. Further, or alternatively, the first and second light means may emit light in response to different or alternating electrical current inputs.

Likewise, any auxiliary lighting that might be provided at each sensor zone to provide background lighting in the respective sensor zones may emit light in different, changing or alternating wavelength or amplitude ranges. Further, or alternatively, the auxiliary lighting may emit light in response to different, changing or alternating electrical current inputs.

In preferred arrangements, the ejector ejects rejected product, i.e. product on which an undesirable defect is detected.

The at least one light source may sequentially illuminate the respective sensing zones, using flashes.

In one arrangement, a first sensor zone operates in, or collects data relating to, light at a first wavelength, or a first set of wavelengths, such as the blue spectrum, and the second sensor zone operates in, or collects data relating to, light at a second wavelength, or a second set of wavelengths, such as the red spectrum. One or the other of these might instead be the green spectrum, or there could be a third sensor zone in the green spectrum, whereby red, green and blue are used.

The first sensor zone may instead simply exclude light from a given area of the spectrum, such as light wavelengths within the red spectrum and the second sensor zone may likewise instead simply exclude light from a different given area of the spectrum, such as light wavelengths within the blue spectrum, etc. This can be achieved with filters.

The two or more sensor zones might be arranged one above the other in a vertically displaced arrangement. They may instead be arranged in lines extending perpendicular to the path of the products through the viewing zone.

Preferably the sorting zone is located below or beyond all the sensor zones, and at a predetermined distance therefrom, whereby upon a determination of a defect occurring, the ejector can trigger an ejection of the defective product by timing an ejection force to be applied as the defective part of the product passes through the sorting zone. Since the velocity of the product is known, the timing can very accurately controlled.

Instead of the above blue, red and green spectrums, other wavelengths could be usefully used as well or instead, such as infrared or ultraviolet spectrums.

The at least one sensor can be a sensor that comprises more than one line of CCD sensor arrays, whereby an upper sensor array may be provided for a first of the sensor zones and a lower sensor array may be provided for a second of the sensor zones. Each sensor array may be sensitive to reflected or transmitted light from a product passing through the viewing zone, and each may be provided with a different filter, or be otherwise sensitive to different light wavelengths.

A common light source may be provided to light a plurality of viewing zones, or a plurality of parallel sensor zones, within the sorting apparatus, each viewing zone or each parallel sensor zone being provided for a separate, parallel running, product stream. With a single light source, in the event of the use of flashed illumination of product, each product stream is illuminated with the same flash frequency—there is thus no need for a separate control of the frequency of flashing on each product stream.

In a further aspect of the present invention there is provided a sorting and inspecting apparatus comprising:

a feed system for delivering a product stream sequentially through an imaging zone and a sorting zone, at least one light source for illuminating a product at the imaging zone, at least one optical sensor and detector circuit for viewing at least a portion of the illuminated product at the imaging zone, for collecting viewed data, for determining a condition of that at least portion of the illuminated product from the viewed data and then for outputting a signal dependent upon the determined condition of that at least portion of the illuminated product, and at least one ejector for ejecting product at the sorting zone dependent upon the output signal, wherein the at least one optical sensor and detector circuit comprises a sensor array in which the pixels are elongated in one direction relative to the other, the other direction being orthogonal to the first, with the array being mounted in the sorting apparatus such that the elongated direction of the pixels extends substantially parallel to the direction of flow of the product to be sorted as it passes through the viewing zone of the apparatus.

With the elongated shape, the pixel will sense any reflected or transmitted light from a product, or a part of a product, for a longer duration of its passage through the viewing zone without compromising the sensor's pixel resolution in the other dimension—the orthogonal direction. This is improves the quality of any collected data from the sensor.

Preferably the pixels are rectangular.

The length of the pixels might be set to correspond with the average distance travelled by the previously described hypothetical product in a scan cycle.

In one embodiment, the pixels may have a length of about 0.29 mm.

The second aspect of the invention may operate with the first aspect of the invention. In this manner, there can be two lines of such arrays, one for each sensing zone of the viewing zone, and via the improved data quality obtained with the elongated pixels, even upon taking only a sector of the collected data, the quality of the data used for the defect detection step will still be sufficient for making an appropriate determination.

The pixel arrays, with separate lines of pixels, will typically be arranged such that the lines are spaced along the direction of travel of the product through the viewing zone.

Preferably the pixel array is arranged within the apparatus with the pixels arranged with their longer dimension arranged substantially along or parallel to the direction of travel of the products through the viewing zone. As such, the pixel array may be arranged within the apparatus with the pixels arranged with their longer dimension arranged substantially vertically. This is particularly useful where the product falls substantially vertically through the viewing zone.

The present invention also provides a sorting apparatus comprising multiple product streams, with multiple sorting zones and multiple imaging zones, and with multiple sensors, one for each product stream, albeit with a common lighting means provided for a plurality of the product streams for illuminating, with a common illumination, a plurality of the imaging zones.

The lighting source might illuminate the imaging zone with sequential flashes of illumination. They may alternate between different wavelengths or different sets of wavelengths, whereby a product passing through the imaging zone will be illuminated first by a first wavelength or set of wavelengths through a first sensing zone of the imaging zone and by a different wavelength or different set of wavelengths as it passes through a second sensing zone of the imaging zone.

The frequency of flashing might remain constant irrespective of the speed of the product stream or streams through the apparatus.

The sector of the collected data from the sensors or the lines of the sensor, is usually a sector based upon a fixed time interval within the passage of time during which the product passes through the sensing zone, the period of time being the same irrespective of the determined speed of the product, and irrespective of the sensing zone being considered. As such, the defect determination is always made from a constant length of time of data collection.

The present invention also provides a method of inspecting and sorting products in a product stream using an apparatus as defined above.

BRIEF DESCRIPTION OF THE SEVERAL VIEWS OF THE DRAWINGS

These and other features of the present invention will now be described in greater detail with reference to the accompanying drawings, in which.

DETAILED DESCRIPTION OF THE INVENTION

Figure 1:
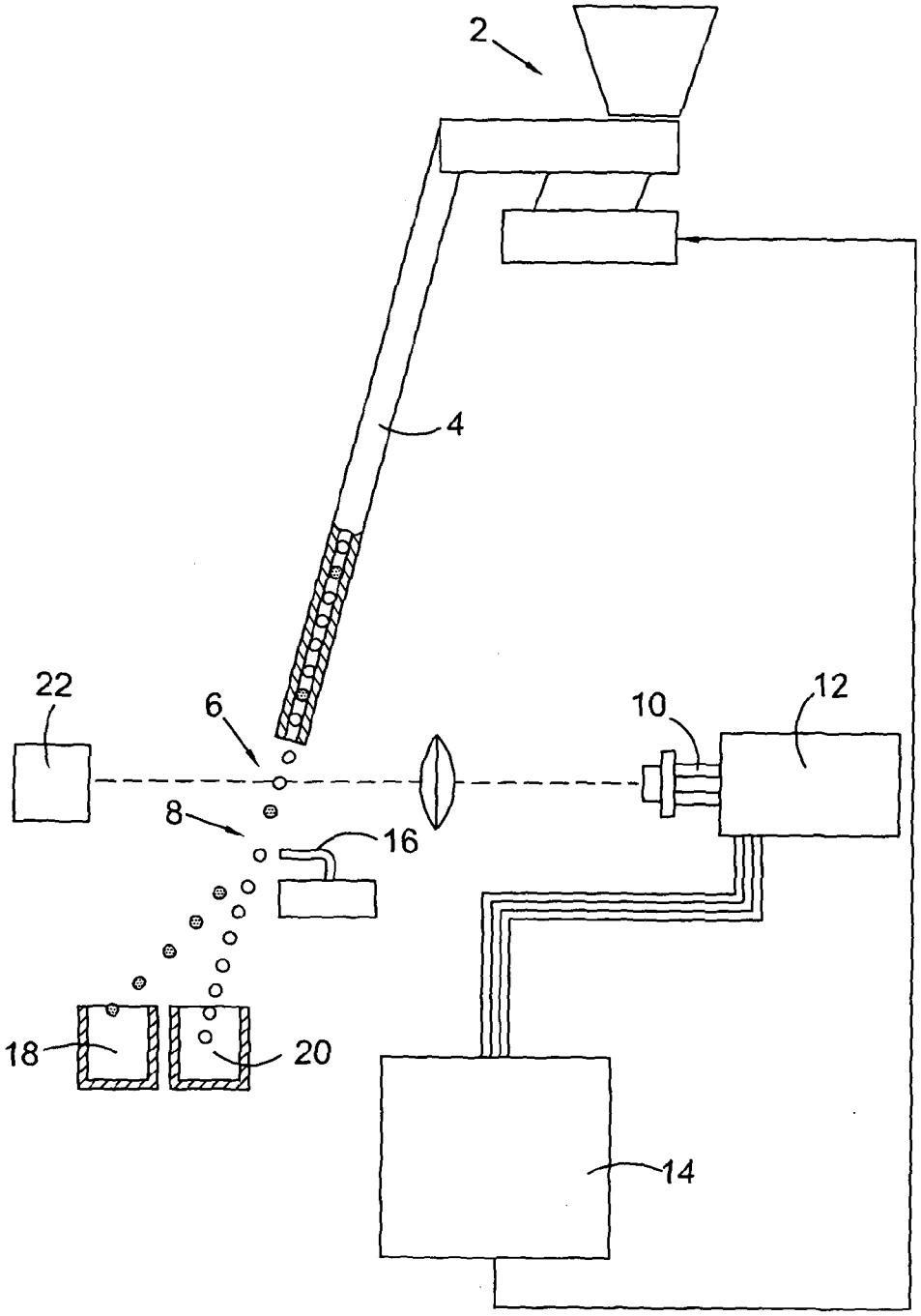
FIG. 1 is a schematic view of a sorting and inspecting apparatus according to the present invention.

Referring to FIG. 1, a sorting and inspection apparatus is illustrated. It has a hopper 2 in which the product to be sorted is loaded. It also has a product chute 4 down which the product to be sorted is fed—it is vibrated to the head of the chute by a vibrator-feeder mounted underneath the hopper 2.

The product chute is substantially vertical in this embodiment—perhaps at an angle of 15.degree. from vertical. The chute may be flatter than this, however, if desired.

At the bottom of the chute—where the product exits the chute—a viewing zone 6 is provided. In this area, a sensor 10 and detection circuit 14 is provided for capturing images of the products as they fall through the viewing area at their individual product velocities and for making a determination as to whether the individual products have undesired defects. A projector 12 provided front-lighting for the products, whereas a backlight or background 22 can be used to assist with the prevention of erroneous defect detection, as known in the art.

Thereafter the products continue to fall—free fall—through a sorting zone 8, and in that sorting zone any product determined to have a defect is automatically ejected by an ejector 16, which is controlled by the detection circuit 14. Those defective products are therefore displaced by the ejector for collection in a defect bin 18. The good product, however, continues to fall into a good product bin 20.

The sensor 10 and detection circuit may also determine the velocity of the individual products, or a separate velocity sensor may be provided at the exit of the chute 4.

Illumination for the product, as it passes through the viewing zone may alternatively be provided by other, conventional, sorting/inspection machine lighting systems (not shown).

Figure 2:
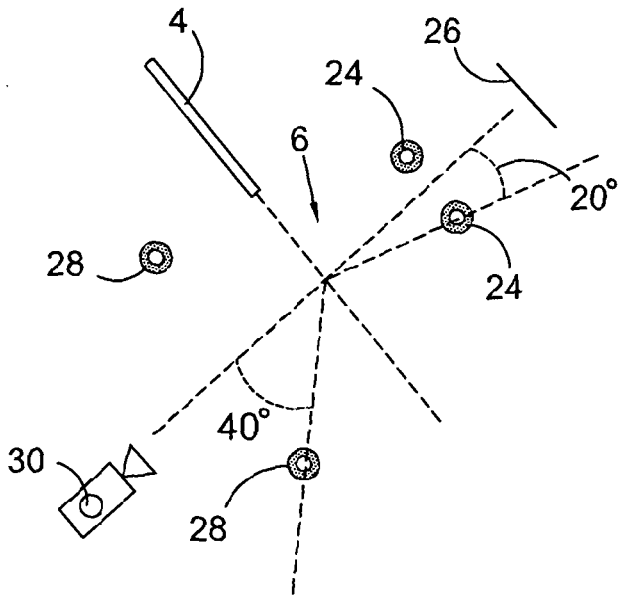
FIGS. 2 and 3 show phasing of illumination of the products for optimising the defect detection process; these further details of possible sensor/light source arrangements are discussed further in a co-pending application, concurrently filed by the present applicant, entitled "Sorting Apparatus with Alternate Side Illumination".
Figure 3:
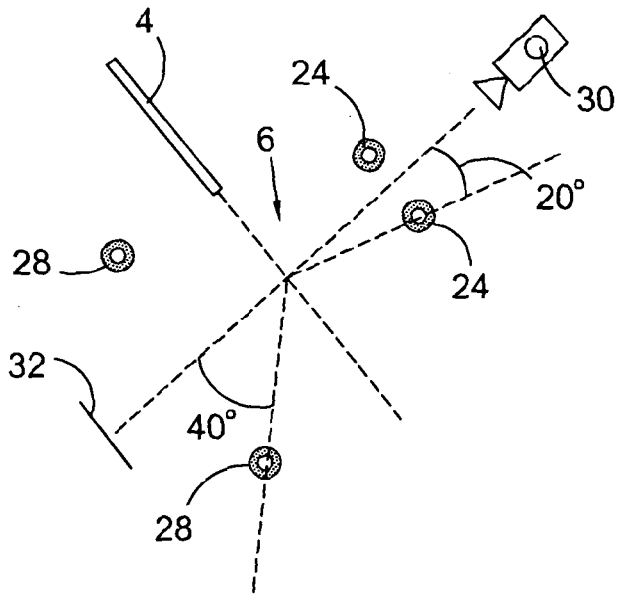

Referring next to FIGS. 2 and 3, further details of possible sensor/light source arrangements are provided.

The sorting apparatus described above can be referred to, in part, as a sorting module, i.e. a collection of items that makes up an identifiable part of a sorting machine and which may occur multiple times depending on machine capacity. Typically a sorting apparatus will consist of one chute plus associated vibrator(s), ejectors, and camera(s) with associated optics and processing. The sorting modules each may consist of one 300 mm wide chute, one vibrator (or two if split), 64 ejectors, four cameras each viewing 150 mm of product (front-left, front-right, rear-left and rear-right), four foreground and two background lighting blocks, and associated processing equipment. However, several of the functional elements might be shared between two or more sorting modules. This may lead to a modularity per machine or unit, for example as follows:

One frame.

Two views.

One HMI and system controller board (master unit only).

One system services board.

One vibrator controller board.

Three or more sorting modules.

at least one sorting board.

In the illustrated apparatus, for example when sorting rice, the product is expected to have a vertical velocity of between 3.57 ms-1 and 3.9 ms-1, and nominally 3.7 ms-1. However, feed plane velocities of between 3.5 ms-1 and 4.3 ms-1 are also likely to occur.

To provide a desirable sort performance with product speeds of this order, pixel dimensions at the feed plane should usually be no greater than 0.292 mm.times.0.292 mm. However, sorting processing costs can be proportional to the number of pixels used, so minimising the number of pixels has a cost saving benefit.

It is generally possible to achieve superior peck (small black spot) sorts with higher resolutions. Such defects are highly visible compared to shading changes/colour defects (yellows/greys/chalky grains) and are easily detectable using a single colour illumination.

Since peck requires simpler processing than colour defects, it is possible to process two separate defect detection data-streams from the sensors (which detect in two colours) independently, whereas for colour defects, bichromatic resolution data-stream is preferred.

It is also preferred to use a higher resolution monochromatic data-stream for spot defects than the resolution used for colour defects.

In view of this, the sensor arrangement may comprise a temporal delay based bichromatic system for determining colour defects, and additionally a higher resolution monochromatic sensor for detecting small black spots.

A preferred arrangement for rice grain sorting apparatus would include colour defect detection using a 0.292 mm.times.0.292 mm pixel resolution, bichromatically, and spot defect detection using a 0.146 mm X-axis (perpendicular to the flow).times.0.292 mm Y-axis (parallel to the flow) pixel resolution, monochromatically.

The higher resolution enables smaller spots to be seen better—spot sizes on rice typically range between 0.875 mm square and 0.146 mm high (Y).times.0.072 mm wide (X), and the pixel sizes listed above reflect an optimum arrangement for an electro-optic scan (EOS) period of 79.1 .mu.s (i.e. where there is a target product velocity of 3.7 m/s). As such, in a preferred apparatus, 2048 pixels are capturing data over the product stream's full width (300 mm), with the image capture per pixel being 0.146 mm horizontally (X) and at 0.292 mm vertically (Y).

The sensor may have 512 lines, whereby an image of 2048 pixels by 512 lines can be captured from the camera for defect determination purposes.

To allow a synchronisation of various elements of the sensor, light source and defect determination parts of the apparatus a system sync signal is provided. It is preferred that the system sync signal be a square wave.

The signal's period is preferred to be modifiable within the range: 68 .mu.s to 84 .mu.s. This period is derived from the time required for a product (in this example a rice grain) to travel the distance between the two lines on the camera sensor. For the distance of 0.292 mm as given above, the above signal period range equates to product velocities of between about 4.3 ms-1 and about 3.5 ms-1.

A minimum signal period is preferably fixed so as to allow sufficient time to allow processing to take place.

In a preferred arrangement, the signal's period shall be modifiable in steps of no more than: 0.75 .mu.s—this maximum step size is based on 1% of the nominal period.

The camera integration period shall be derived from the system sync signal.

It is necessary to be able to alter the camera integration period since the 'delay based' colour system (see below) needs to align the data for the two colours to the same (Y) position. This is done by assuming that the product has moved, during one scan period, from a first line of the sensor to the next, e.g. between a blue sensing line and a red sensing line, those lines collecting the relevant data during that scan period. The camera integration period is then altered to match the average, nominal or hypothetical velocity of the product in the product stream.

Referring next to FIGS. 2 and 3, the concept of phasing or phased illumination in the viewing zone will be discussed. It provides alternate illumination of opposite sides of the product stream and it helps to optimise the detection process.

In the arrangement shown, the front and rear views of the product have different lighting setups. Two camera/sensor/lighting/background arrangements are used, with the lighting arrangements being asymmetric.

As shown, product pieces are delivered in a stream from a chute 4 in free flight through a viewing zone indicated generally at 6. FIG. 2 shows a first phase in a scanning operation in which first light means in the form of arrays of light emitting diodes 24 illuminate product in the viewing zone 6. Light reflected from the product is received by the line scan camera 26 which generates and transmits signals to a computer (not shown) for analysis. As can be seen, the arrays of diodes 24 are disposed symmetrically on either side of the path of reflected light, at an angle of incidence of around 40.degree.

Lighting is provided in the first scanning phase shown in FIG. 2, by a second light means also in the form of arrays 28 of diodes on the other side of the viewing zone 6. The arrays 28 illuminate the viewing station from an angle different from that of the arrays 24, in the arrangement shown at an angle of incidence of around 20.degree. Background lighting is provided by an auxiliary light source 30.

In the arrangement shown in FIG. 2, in a first scanning phase, the LED arrays 24 illuminate the viewing station with light in the red and blue wavelength ranges while the LED arrays 28 provide lighting in the red wavelength range only. Background lighting (30) aligned with the camera 26 is also provided in the red and blue wavelength ranges.

In the second scanning phase illustrated in FIG. 3, the roles of the LED arrays 24 and 28 are reversed. The arrays 24 are switched to emit light only in the red wavelength range while the arrays 28 are switched to emit light in the red and blue wavelength ranges. In this phase, light reflected from product pieces in the viewing station is received by the camera 32 which generates and transmits signals to the computer for analysis.

Instead of, or in addition to, colour changes, the intensity of the illuminations may be changed or alternated.

While the LED arrays will continuously switch between scanning phases, the two cameras 26 and 32 can continue to receive reflected light and transmit signals to the computer during both phases. The computer can be programmed to discard data received but not required in a particular phase. Thus, the lighting alternates such that only in each phase does each camera have the lighting it requires. Illumination differences occur between the phases, however, due to the above indicated asymmetry.

With phasing, therefore, the front and rear views of the product should have different lighting setups—two camera/sensor/lighting/background arrangements are typically used. For example, the lighting arrangements shown in FIGS. 2 and 3 is asymmetric, with rear foregrounds at about 40.degree. to the rear cameras and front foregrounds at about 20.degree. to the front cameras.

These lighting setups may be mutually incompatible, but the concept of phasing serves to get around this issue.

Phasing can involve dividing the system sync period into two equal phases, 'phase #1' and 'phase #2'. Phase #1 might be used by the rear view camera, and it uses a same-side foreground red & blue lighting arrangement, with the other side foreground being red only lighting. Phase #2 might be used by the front view camera, also uses same-side foreground red & blue lighting, with the other side foreground being red only lighting. However, in this arrangement the lighting can be flashed such that only in each phase does each camera have the lighting it requires. Illumination differences occur between the phases, however, due to the above indicated asymmetry.

Any camera data captured during the phase meant for the other camera might be discarded—lights do not snap instantly on or off, so discarding such data can be helpful.

The flashing foreground lighting can be done with the two different configurations, as tied to the two phases of the system sync period.

The pixel geometry in the cameras is preferably modified such that in the product flow direction, the y-resolution of the detector photo-site equals the y-resolution of the machine (i.e. 0.292 mm in the example given).

Phase #1 might operate as follows (for rice sorting)—the rear view can separate out chalky, peck, dark yellows, subtle yellows, greys and paddy. The front view simply discards its data—it is too difficult to differentiate paddy from chalky from peck, or subtle yellows from greys. There are also problems with brown peck.

Phase #2 might operate as follows—rear view data is discarded, and for the front view, it is possible either to separate peck and paddy or to take a second shot at removing chalky, peck, dark yellows, subtle yellows, greys and paddy.

Other arrangements are possible within the scope of the invention.

Figure 4:
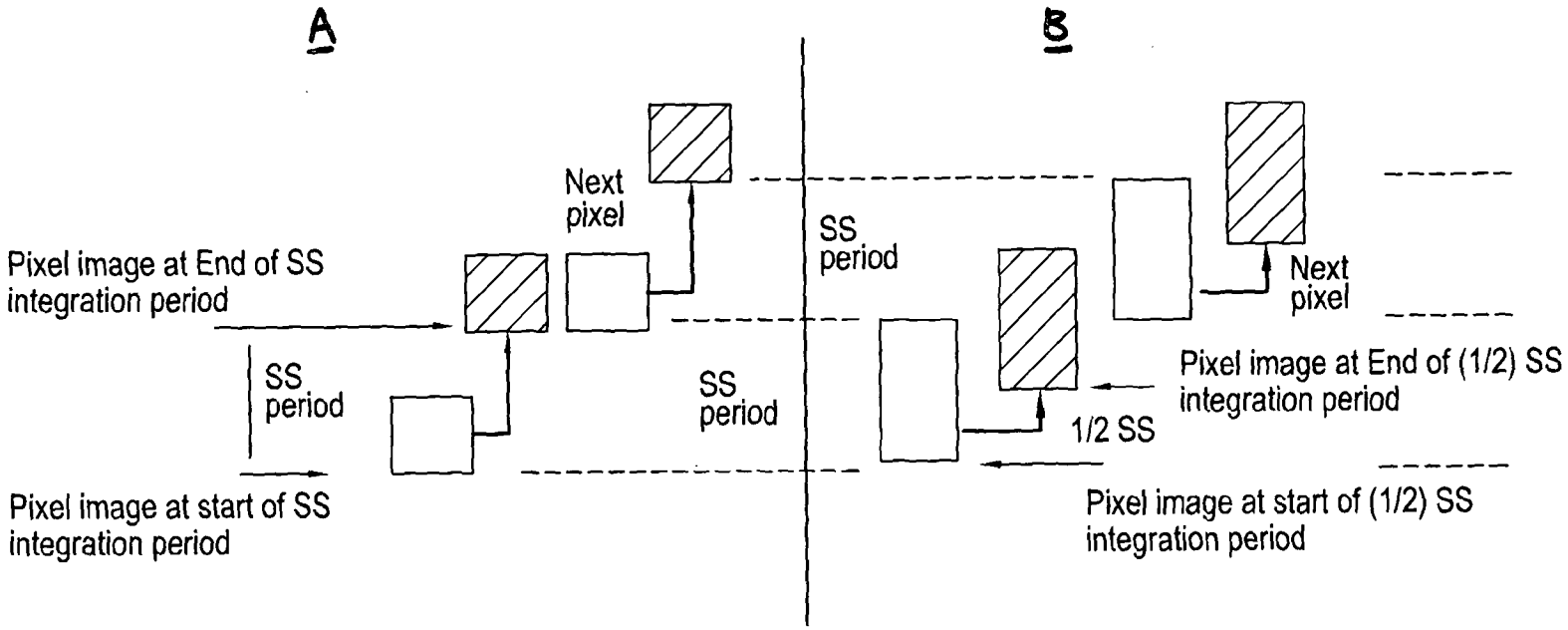
FIG. 4 illustrates the data collection improvement with the elongated pixels of the present invention compared to traditional square pixels.
Figure 5:
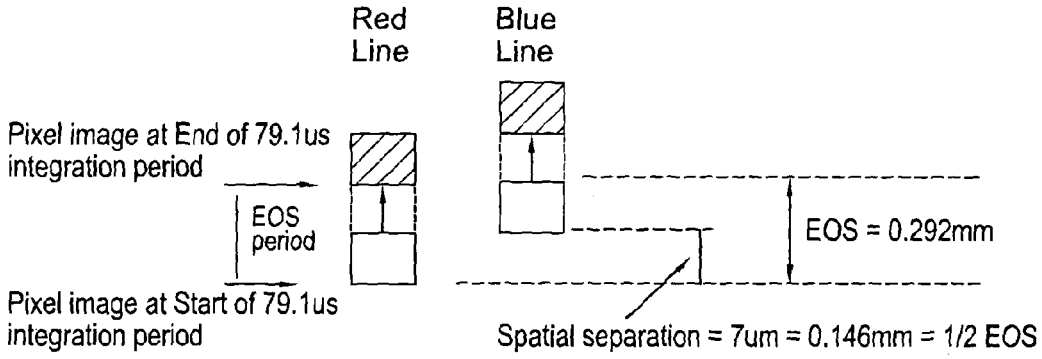
FIGS. 5 and 6 further illustrate the improvement in the quality of the collected data using elongated pixels (FIG. 6) compared to square pixels (FIG. 5)
Figure 6:
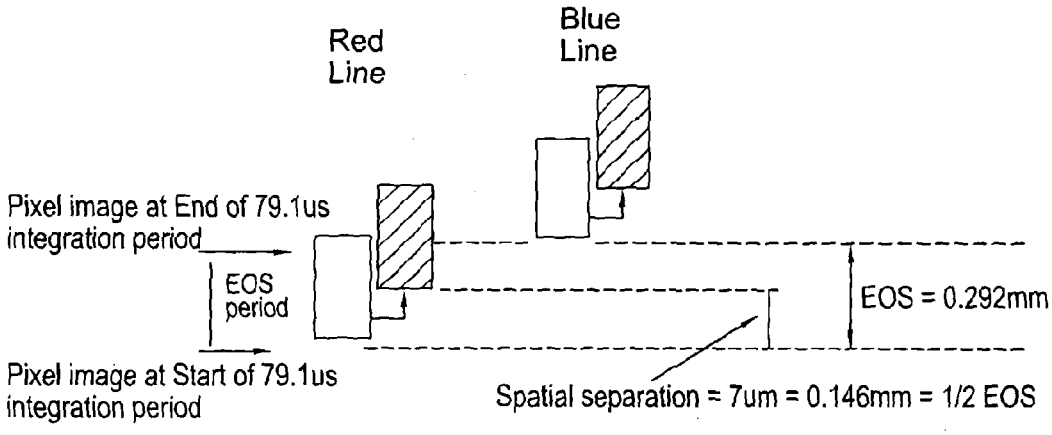

Referring next to FIG. 4, the following explains why a different geometry pixel is desired. FIG. 4 compares square pixels against the modified rectangular pixels (having a length of 0.292 mm). In the non-phasing square pixel case, a photo-site images ½ of the y-resolution of the system. At the start of an SS period, the photo-site images instantaneously, which in this case would be a ½ y-resolution. Then, at the end of a full SS scan period, the pixel again images instantaneously a ½ y-resolution, with the distance the product has travelled in the SS period (set to be the y-resolution by system design) between these points. The pixel will integrate all the instantaneous values between these points.

In the Phasing case, the photo-site will image the full y-resolution initially instantaneously, such that after the SS period, when integration of that photo-site stops, the end point will be at the same point as in the non-phasing case. The elongated pixel therefore captures the full amount of information, rather than just half of it.

The sorting apparatus also performs a defect detection using a spatiotemporally aligned sensor system, which is particularly useful for colour defect detection. This can be adopted using a sensor with two lines, one after the other, each with a discrete colour filter, where the colour alignment is achieved by temporally delaying one line output signal to match the other. This works well, and easily, where the product has fallen one line width distance between scans, i.e. it has a fixed velocity corresponding to the hypothetical velocity for which the system scan period is set. However, for products with a different velocity, such matching fails.

Nevertheless, to keep the data collection simple, the present invention's spatiotemporal alignment still involves setting the system scan period to the median of product chute (exit) velocity, and the collected data is processed to correct for velocity variations of even up to 20% from the median.

With the present invention, there is preferably only one scan period used by the apparatus—multiple scan periods can cause technical headaches in terms of synchronisation of the hardware, and the detection/ejection behaviour, plus pixel sizes and scan lengths would also vary across the apparatus. The present invention's single scan period therefore simplifies these elements, thus maintaining low manufacturing/set-up costs.

With the present invention, it is preferred that the foreground lighting is flashed, and this is done in synchrony with the scan period, and that too would make it impossible or difficult to support multiple scan periods, i.e. without having a machine of huge width (infill angle).

A difficulty with the single flash speed, however, is that it will not be optimised for the products travelling with the largest speed deviations from nominal. In particular there can be a trade off on exposure time (i.e. light).

The present invention therefore overcomes this by providing/creating a fixed width window (sector) that is smaller than the full window for that scan period within each ½ SS by using an exposure control. That sector or window may be slid anywhere within the ½ SS period as long as it is not clipped at either end. See FIG. 8.

Each 'colour' line of the sensor uses an independent window, and since each window can correspond fully to one from the other line, a good match is achievable for any velocity of product within the range of velocities expected. That is because the sectors are appropriately chosen to have the suitable temporal delay.

The change in temporal relationship between the exposure windows of the two sensor lines therefore translates into attempting to align the colours to product that has travelled different distances. The present invention therefore compensates for different product velocities.

Figure 7:
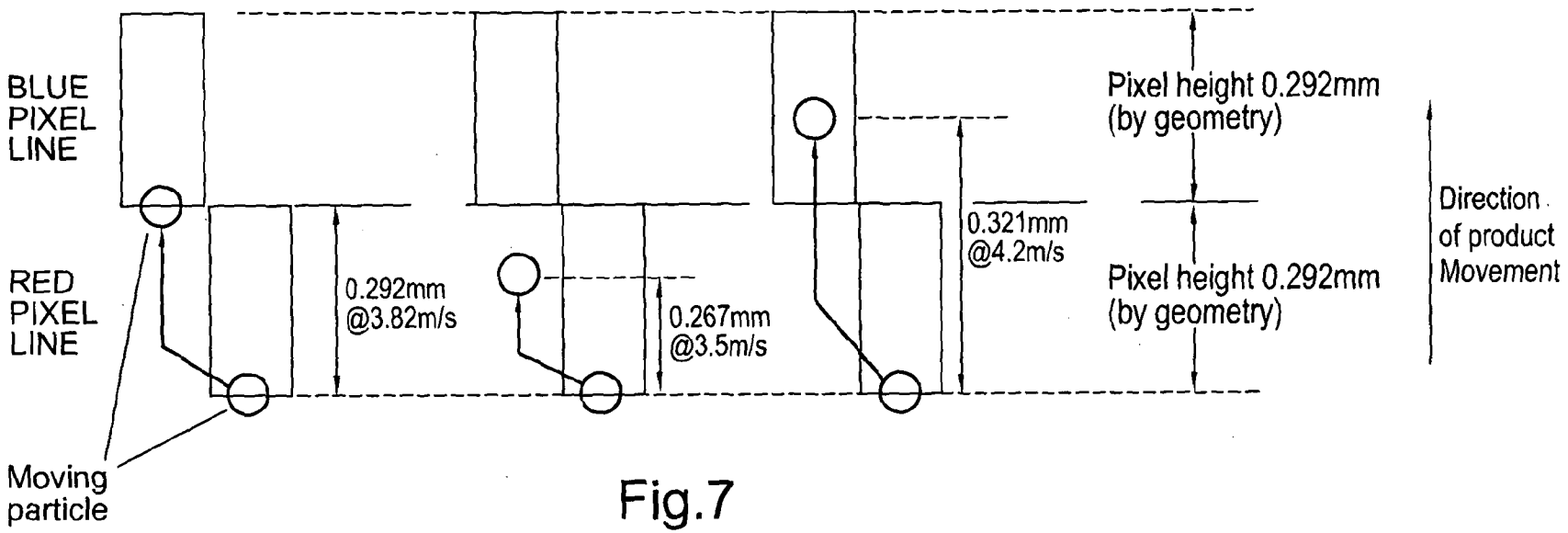
FIG. 7 shows the variance in travel distance across the sensing zone for products having different velocities.

FIG. 7 helps to illustrate the problem associated with products moving at different velocities through a viewing zone—it shows how far a particle moves with respect to the photosites of a 2 line sensor, one with a red filter, one with a blue filter, at different particle velocities.

Figure 8:
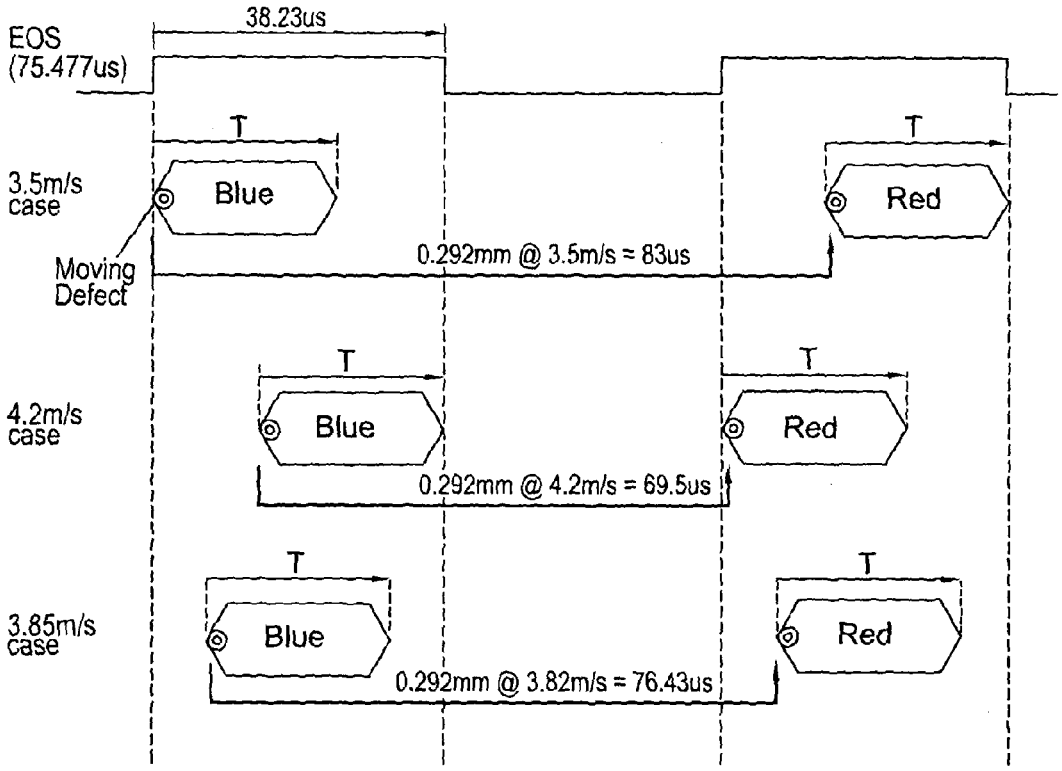
FIG. 8 illustrates the selection of sectors within the scan period for products having different velocities for optimising cross-checkability between defect determinations in separate lines of a sensor.

FIG. 8 then shows the solution using exposure control as exemplified by a moving defect for a case where the blue filtered sensor line is above the red filtered line.

Worst case average product velocities of 3.5 m/s and 4.2 m/s occurring on different chutes of the same machine are considered.

The System Sync (SS) has been set to the median delay equivalent to 0.292 mm at each of the extreme velocities.

$$\text{Median delay} = \frac{((0.292\ \text{mm@3.5 m/s}) + (0.292\ \text{mm@4.2 m/s}))}{2} = \frac{(83.429\ \text{us} + 69.524\ \text{us})}{2} = 76.477\ \text{us}(3.82\ \text{m/s})$$

The solution requires that the sensor exposure of each of the colours be moved relative to each other in time within the fighting (½ SS) window provided.

Since we flash the LEDS, each ½ SS has the ideal lighting for either the front, or rear cameras.

In each case a defect or product point, just moving onto the active area of the blue sensor is considered, along with the time for that defect to move 0.292 mm, the area imaged by the pixel. For faster moving defects this time is shorter, for slower moving defects this time is longer.

The solution is considered optimal since with the exposure time of both the colours moving, each only has to move half the distance it otherwise would, and consequently the exposure window size can be kept as wide as possible (T=31.71 us).

The present invention has been described above purely by way of example. It will be appreciated, therefore, that modifications in detail may be made to the invention, as defined by the claims appended hereto.

EXPLANATORY TEXT FOR DRAWINGS

| Figure | Text |
|---|---|
| 4 | A: Non-phasing square pixel case<br>B: Phasing rectangular pixel case |
| 5 | 1024 × 7 × 7 um pixels look over 150 mm (7 um = 0.146 mm) 2 colour lines next to each other |
| 6 | 1024 × 14 h × 7 w um pixels look over 150 mm (7 um = 0.146 mm) 2 colour lines next to each other |
| 7 | Shows movement of a particle of product after a time (dt) = time for 0.292 mm movement at 3.82 m/s<br>Blue/red pixels particles seen at same equivalent point (aligned) at 3.82 m/s obviously not at 3.5 m/s or 4.2 m/s |
| 8 | EOS @ 3.818 m/s (mean eos) = 76.477 us<br>Consider 3.5 m/s case: T = (3 × (1/2EOS)) − 83 us = 31.71 us<br>So Maximum Integration time = 31.71/38.23 × 100 = 83.0% maximum for 1/2EOS<br>To make up for this therefore we need 100 − 83 = 17% more Light (than we would otherwise at 76.43 us scan period)<br>100 − (31.71/39.59 × 100) = 20% more light than at the Z scan period (79.1 us) |

The invention claimed is:

1. A sorting and inspection apparatus comprising multiple product streams, with multiple sorting zones and multiple imaging zones, and with multiple optical sensors, one for each product stream, the apparatus further comprising a common lighting means provided for a plurality of the product streams for illuminating, with a common illumination, a plurality of the imaging zones, wherein the common lighting means illuminates the plurality of the imaging zones with sequential flashes of illumination synchronized with a scan cycle of the optical sensors.

2. An apparatus according to claim 1, further comprising:

a feed system for delivering each product stream sequentially through one of the multiple imaging zones and one of the multiple sorting zones, at least one ejector for ejecting product pieces from product streams at respective sorting zones dependent upon an output signal from one of the optical sensors, wherein each optical sensor is configured and arranged to:

view at least a portion of the respective product stream illuminated at the optical sensor's respective imaging zone, collect viewed data, determine a condition of the at least a portion of the respective illuminated product stream from the viewed data, and output the output signal dependent upon the determined condition of the at least a portion of the respective illuminated product stream.

3. An apparatus according to claim 2, wherein the multiple optical sensors each comprise an array of pixels which each have an elongated shape, wherein the multiple optical sensors are mounted in the sorting and inspection apparatus such that the longer dimension of each of the pixels extends substantially parallel to a direction of flow of the respective product stream.

4. The apparatus of claim 2, wherein the pixels have a longer dimension that corresponds with an average distance travelled by a hypothetical product piece in one of the product streams moving at the median velocity of the respective product stream, during the course of one of the scan cycles of the respective at least one optical sensor.

5. An apparatus according to claim 2, wherein an average speed of one of the multiple product streams is different to an average speed of another of the multiple product streams, wherein at least one of the optical sensors comprises at least two sensor zones, sequentially arranged one after another in a direction of flow of the respective product stream, whereby collection of data corresponding to a particular portion of the product stream is temporally delayed between an earlier one of the sensor zones and a subsequent one of the sensor zones by a temporal delay (which correlates with the average speed of the respective product stream and a physical distance between the at least two sensor zones), wherein data is collected at each sensor zone over a fixed time interval within a passage of time during which a product piece passes through the respective sensor zone, which fixed time interval corresponds to a sector of the scan period of the respective optical sensor, and wherein the sorting and inspection apparatus is configured and arranged to compensate for the different product stream average speeds through selection of a suitable temporal delay between a sector in the earlier one of the sensor zones and a sector in the subsequent one of the sensor zones such that the suitable temporal delay matches the temporal delay, whereby a correlation of detections from the earlier sensor zone to the subsequent sensor zone is achieved and cross-checkability between defect determinations in the separate sensor zones is optimized.

6. The apparatus of claim 5, wherein each optical sensor comprises a pixel array comprising multiple lines of pixels, which are arranged so as to collect data from each of the earlier sensor zone and the subsequent sensor zone.

7. The apparatus of claim 1, wherein the multiple product streams pass through the multiple imaging zones and the multiple sorting zones purely under the influence of gravity.

8. The apparatus of claim 5, wherein the earlier sensor zone operates in, or collects data relating to, light at a first wavelength, or a first set of wavelengths, and the subsequent sensor zone operates in, or collects data relating to, light at a second wavelength, or a second set of wavelengths.

9. The apparatus of claim 5, wherein the at least two sensor zones are arranged generally one above the other in lines extending perpendicular to the path of the products through the viewing zone.

10. The apparatus of claim 5, wherein the multiple sorting zones are located below or beyond the multiple imaging zones, and at a predetermined distance therefrom, whereby upon a determination of a defect occurring, the ejector ejects defective product by timing an ejection force to be applied as the defective product passes through one of the sorting zones.

11. An apparatus according to claim 1, wherein the frequency of flashing remains constant.

* * * * *